US005339652A

United States Patent [19]

Dreiman

[11] Patent Number: 5,339,652

[45] Date of Patent: Aug. 23, 1994

[54] SOUND AND VIBRATION ABSORBING DAMPER

[75] Inventor: Nelik I. Dreiman, Tipton, Mich.

[73] Assignee: Tecumseh Products Company, Tecumseh, Mich.

[21] Appl. No.: 123,606

[22] Filed: Sep. 17, 1993

[51] Int. Cl.[5] ..... F25D 19/00

[52] U.S. Cl. ..... 62/296; 181/403; 417/312

[58] Field of Search ..... 62/296; 417/312; 181/403, 202, 229, 207

[56] References Cited

U.S. PATENT DOCUMENTS

| | | | |
|---|---|---|---|
| 2,205,138 | 6/1940 | Gould | 62/115 |
| 2,469,167 | 5/1949 | Little | 174/42 |
| 2,500,751 | 3/1950 | Halfvarson | 230/208 |
| 2,721,028 | 10/1955 | Dills | 230/232 |
| 3,273,670 | 9/1966 | Kleinlein | 188/1 |
| 3,386,527 | 6/1968 | Daubert | 181/33 |
| 3,847,330 | 11/1974 | Morrison | 248/14 |
| 3,873,052 | 3/1975 | Bockau | 248/20 |
| 4,345,882 | 8/1982 | Saito et al. | 417/312 |
| 4,347,042 | 8/1982 | Holdsworth | 417/53 |
| 4,347,043 | 8/1982 | Morris | 417/53 |
| 4,799,653 | 1/1989 | Kramer | 267/136 |
| 4,962,826 | 10/1990 | House | 181/207 |

*Primary Examiner*—William E. Tapolcai
*Attorney, Agent, or Firm*—Baker & Daniels

[57] ABSTRACT

A hermetic compressor including a vibration damper situated around the outside of the compressor housing. The vibration damper is constructed from a length of wire wrapped around the housing to form a plurality of windings each winding in contact simultaneously with an adjacent one and the housing. The wire is wrapped about portions of the housing having the highest acceleration and vibration production potential. Alternatively, the windings may be formed of separate wires connected to a bracket and, further, more than one layer of windings of the equal or different diameters is possible.

24 Claims, 3 Drawing Sheets

SOUND AND VIBRATION ABSORBING DAMPER

BACKGROUND OF THE INVENTION

The present invention relates generally to a hermetic compressor and more particularly to small refrigeration compressors used in household appliances. An area of interest in the compressor art is how to construct a quieter compressor. In the past, excessive sound and vibration has emanated from the compressor housing.

Prior attempts at combating the transmission of sound and vibration to the environment in which the compressor is located have not been totally successful. U.S. Pat. No. 2,721,028 discloses an arrangement of resilient plastic blocks disposed upon the outer housing of the compressor to reduce the sound and vibration transmitted from the compressor housing. This design does not reduce vibration over a large area of the compressor housing.

Another U.S. Pat. No. 4,799,653, discloses a method of radial vibration attenuation in which concentric rings or tubes are separated radially by corrugated sheets or wires made of spring steel located in radially aligned grooves for attenuating radially occurring oscillations, damping shocks and vibration.

U.S. Pat. No. 2,205,138 discloses a cooling jacket for a motor compressor useful in compressing refrigerant. The cooling jacket comprises a coil of tubing wrapped about the compressor housing forming loops in thermal contact with a corrugated fin structure located within the compressor housing. As stated in the patent, slipping between the cooling coil loops, caused by transverse relative movement, would not be desirable or acceptable since it would reduce the cooling ability of the coils and increase the possibility of water leaks due to wear of the tubing walls. The water cooling jacket is not particularly useful as a sound deadening jacket as an additional sound jacket is needed about the compressor as shown in the patent. The additional sound reduction jacket is recommended to reduce sound induced by vibration of the casing which is triggered by impacts of the tubing walls between each other and with the external surface of the housing.

Many damping techniques are known, but the need for effective means for damping vibrations become more difficult to achieve as the external surface temperature of the compressor increases. Use of visoelastic polymer materials to reduce noise and vibration is common. However, it is difficult to obtain polymers capable of withstanding temperatures of above approximately 150° C. for long periods of time and use of polymer material often affects heat transfer from the compressor to the environment.

It is therefore desired to overcome the aforementioned prior art problems associated with hermetic compressors to provide a simple sound damping system which is inexpensive and further increases heat transfer from the compressor.

SUMMARY OF THE INVENTION

The present invention overcomes the disadvantages of the above described prior art hermetic compressors by providing a sound absorbing damper wrapped around the compressor housing.

Generally, the invention provides a plurality of wire coils wrapped about the housing adjacent the internal motor-compressor unit. These wire windings about the housing are located adjacent to each other so that vibrations arising during compressor operation trigger oscillation and sliding of the wire windings against each other and along the surface of the compressor housing thereby creating friction. In this way, absorbed vibration energy from the housing is transformed into heat. Such absorption and dissipation of energy reduces the amplitude of vibrations and noise radiated from the housing to the environment in which the compressor operates.

In one form of the invention, two separate sets of solid wire windings are used, one over the other, to reduce sound and vibration transmission, while increasing heat exchange to the environment. The two separate sets of wire used in the windings may be of equal or unequal diameter.

In another form of the invention, separate solid wire loops are attached to a mounting bracket bordering about the refrigerant line attached to the housing. The wire windings are still located so that each winding is in contact with an adjacent winding. By using separate windings attached to a mounting bracket, the damping assembly may easily be slid onto a compressor housing about the refrigerant line.

In yet another form of the invention, the windings may all be created from a single strand of wire. By utilizing a single solid wire strand, winding of the wire about the compressor can be easily added even to existing compressors in the field.

An advantage of the sound damper of the present invention, according to one form thereof, is that of creating a simple and economical structure to reduce sounds and vibrations emanating from the compressor.

Another advantage of the present invention, is that of increased heat transfer from the compressor to the outside environment. This is accomplished by increasing the radiant surface area of the compressor.

The invention, in one form thereof, provides a compressor having a motor-compressor unit disposed within the housing for compressing fluid, and wire wrapped about the housing to form a plurality of windings. The windings are wound such that adjacent windings are in contact with each other and housing so that vibration energy of the housing is transformed into heat energy by friction thereby reducing the sound emanating from the compressor. The wire is wrapped about portions of the housing having the highest vibration amplitude during compressor operation.

In another form of the invention, the housing, enclosing a motor-compressor unit, has a plurality of wire windings wrapped about the housing, each wire winding in contact with an adjacent winding whereby the wire windings, during operation, slide against adjacent windings thereby dissipating vibration energy from the compressor. A bracket may be used to connect together the wire windings so that the assembly may be slid upon the compressor housing. The bracket may be a U-shaped member formed from a steel angle shaped length of material or alternatively a single rod for ease of wire attachment thereto.

In another form of the invention, a compressor housing containing a motor compressor unit may be wrapped by a first plurality of wire windings, each in contact with an adjacent winding and a second plurality of wire windings wrapped about the first set of windings. During compressor operation, each of the wire windings of either the first or second set slide against adjacent windings thereby dissipating vibration energy from the compressor. The radii of the first and second set of wires may be equal or unequal.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein.

Figure 1:
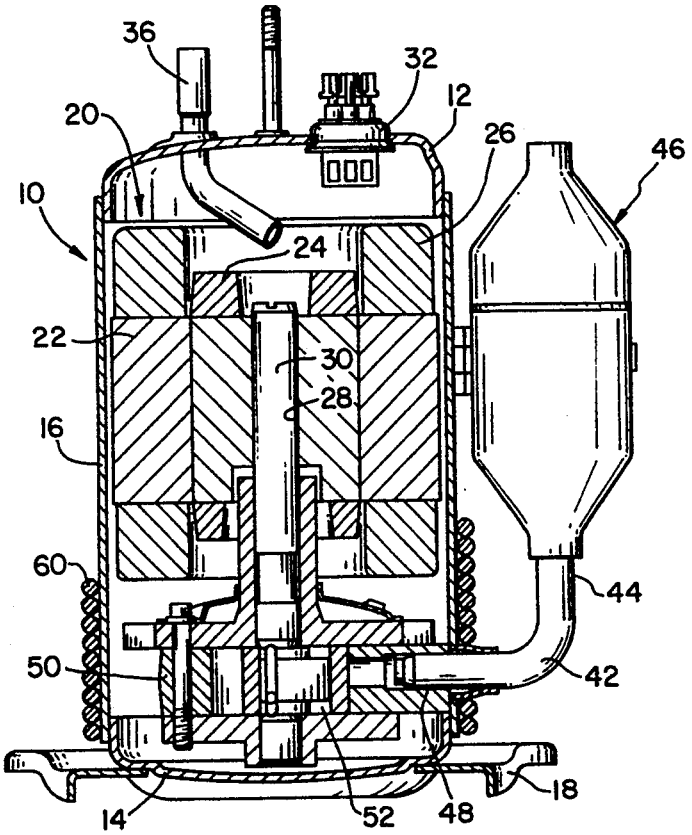
FIG. 1 is a side sectional view of a rotary compressor incorporating the present invention in one form thereof.

Corresponding reference characters indicate corresponding parts throughout the several views. The exemplifications set out herein illustrate a preferred embodiment of the invention, in one form thereof, and such exemplifications are not to be construed as limiting the scope of the invention in any manner.

DESCRIPTION OF THE PREFERRED EMBODIMENT

In an exemplary embodiment of the invention as shown in the drawings, and in particular by referring to FIG. 1, a compressor is shown having a housing generally designated at 10. The housing 10 has a top portion 12, a lower portion 14 and a central portion 16. The three housing portions are hermetically secured together as by welding or brazing. A flange 18 is welded to the lower portion 14 of housing 10 for mounting the compressor. Located inside the hermetically sealed housing 10 is a motor generally designated at 20 having a stator 22, provided with windings 26, and a rotor 24. Stator 22 is secured to housing 10 by an interference fit such as by shrink fitting. Rotor 24 has a central aperture 28 provided therein to which is secured a crankshaft 30 by an interference fit. A terminal cluster 32 is provided on the top portion 12 of the compressor for connecting the compressor to a source of electric power.

A refrigerant discharge tube 36 extends through the top portion 12 of the housing and into the interior of the compressor as shown. Similarly, a refrigerant suction tube 42, causing a discontinuity in the compressor housing, extends into the interior of compressor housing 10 and is sealed thereto as by soldering, brazing or welding. The outer end 44 of suction tube 42 is connected to an accumulator 46. At inner end 48, suction tube 42 is connected to compressor cylinder block 50.

FIG. 1 shows a rotary compressor similar to that shown in U.S. Pat. No. 4,881,879 assigned to the assignee of the present invention and expressly incorporated by reference herein. A cylinder block 50 contains a compressing or pumping means such as a roller 52 connected to crankshaft 30. Although the present invention, to be described below, is shown in conjunction with a rotary compressor, the use of the sound absorbing damper in not limited to rotary compressors. The sound absorbing damper may be utilized with reciprocating piston, scroll, and various other types of compressors.

The present invention, as shown in the embodiment of FIG. 1, comprises a length of solid wire 60 wound into a number of windings about housing central portion 16. Wire 60 is wound into a series of closed wire coils or loops such that each coil or winding contacts an adjacent winding. Wire windings 60 encircle the area of compressor housing 10 containing the highest level of vibrations. In most cases, this location will be the housing portion located directly adjacent compressor cylinder block 50, i.e., the area having the highest acceleration and therefore the largest vibration response.

Attachment of the sound absorbing damper to housing 16 is either by welding or brazing the ends of wire 60 to an adjacent winding or attaching the ends of wire 60 to the housing 16 directly by either welding, soldering or brazing.

Figure 2:
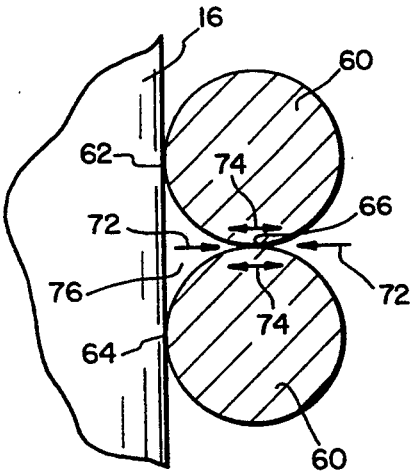
FIG. 2 is an enlarged fragmentary sectional view of the housing showing two adjacent windings.

As shown in FIG. 2, adjacent windings 60 contact housing 16 at interfaces 62 and 64. Adjacent windings contact each other at contact points 66.

In the preferred form of the invention, wires 60 are formed from metal, either steel, copper or aluminum. Preferably, wires 60 are approximately 0.049 inches (gage No. 18) to 0.165 inches (gage No. 8) in diameter. Wire 60 should have a finish of approximately 125 $\mu$m to ensure that the appropriate amount of friction will be produced. Alternatively, other metals or high strength composite materials may be used to form wires 60.

Figure 3:
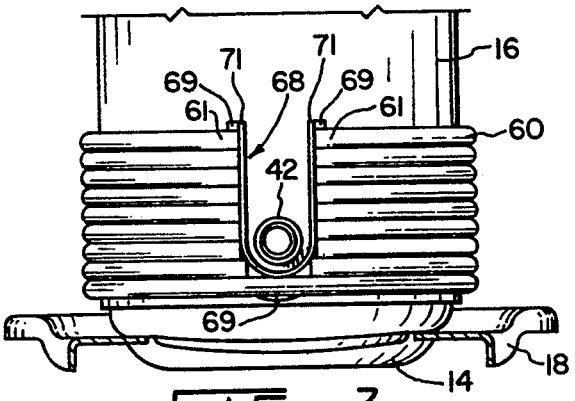
FIG. 3 is an elevational view of showing an alternate embodiment of the invention.
Figure 6:
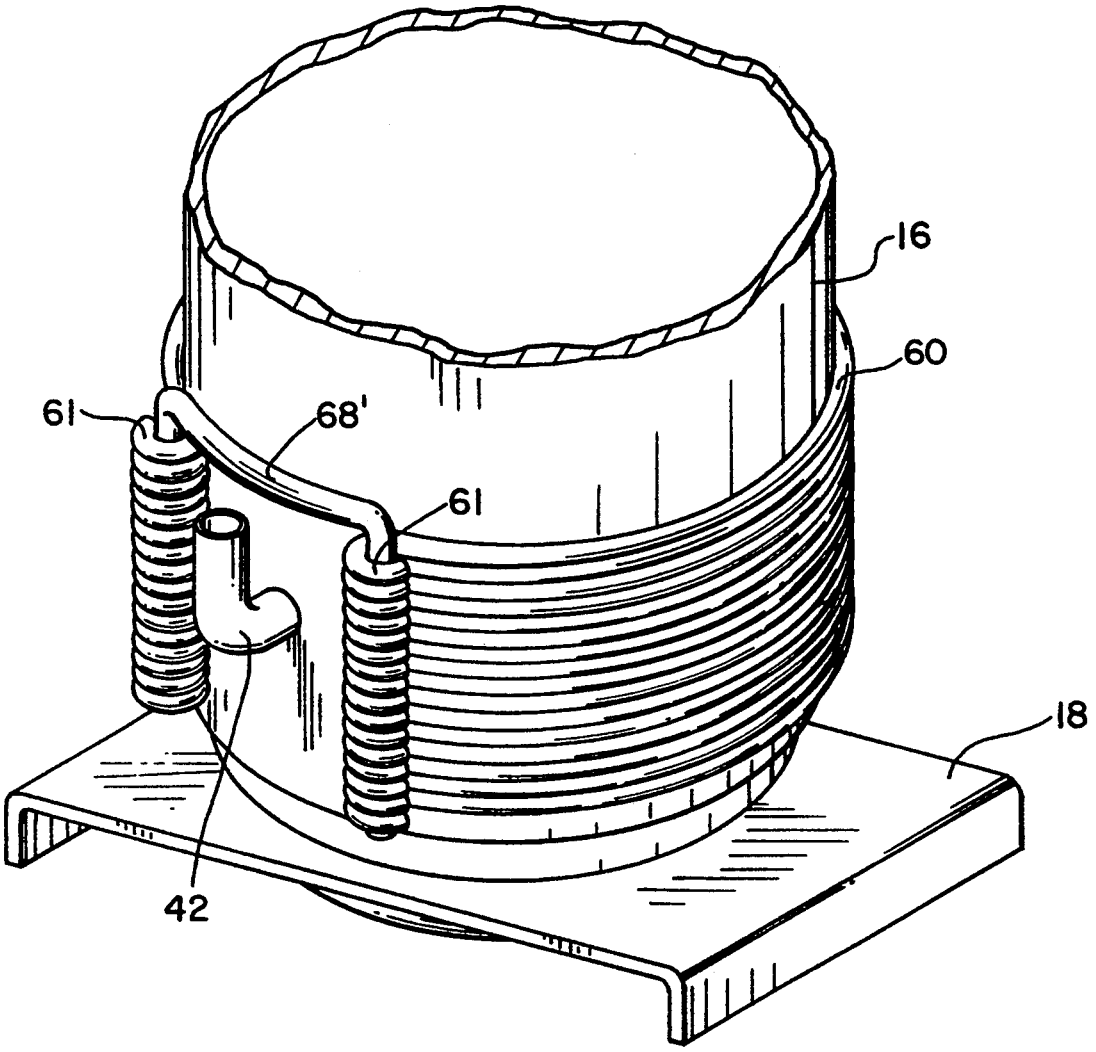
FIG. 6 is a perspective view of another alternate embodiment of the invention.

In an alternate embodiment as shown in FIGS. 3 and 6, instead of utilizing a single wire to create the windings, a plurality of wires 60 create the windings and attach to a bracket 68 which is U-shaped. Utilization of a U-shaped bracket 68 permits locating windings 60 about the housing having the highest inertial acceleration caused by the internal compression mechanism (i.e. the highest vibration amplitude). Further and more importantly, the U-shaped bracket 68 permits a compressor housing discontinuity such as suction tube 42 access through housing 16 into cylinder block 50.

FIG. 3 shows a particular U-shaped metal bracket 68 to which the ends 61 of wires 60 are attached as by welding or brazing.

Bracket 68, in one form, may be created from a length of angle steel formed into a "U" shape. As shown in FIG. 3, bracket 68 includes a ledge 69 on which ends 61 of the wire winding lie and attach. An upstanding portion 71, forming the inside surface of bracket 68, spans the maximum size of the refrigerant line 71 that the damper can border.

Alternatively, as shown in FIG. 6, bracket 68' may comprise a bent metal rod to which wire 60 are attached by means of crimping wire ends 61 about the parallel portions of bracket 68. This attachment method eliminates the need for brazing or welding. Each bracket 68 or 68' maintains wires 60 adjacent to each other and in contact with housing 16.

Figure 4:
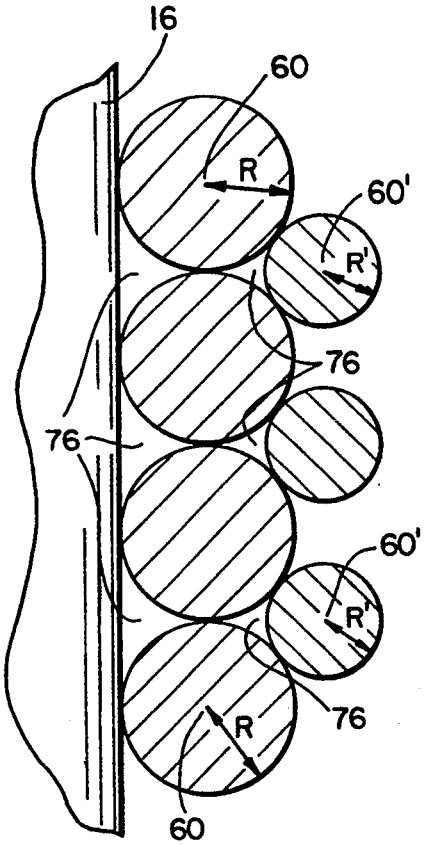
FIG. 4 is an enlarged sectional view of an alternate embodiment of the invention.

FIG. 4 shows another alternative embodiment in which two types of wire are utilized for constructing the windings 60 and 60'.

Each type of wire winding 60 and 60' includes a particular radius R and R' respectively. The difference in radii between the wires cause the wires to closely pack together and form substantially enclosed volumes 76 of air. The wire windings 60 and 60' may be attached to compressor 10 by any of the methods disclosed above.

In this form of the invention, the two sizes of wire contact adjacent wire windings such that radius R is larger than radius R'. In particular, the size ratio shown in FIG. 4 between R and R' is approximately two to one, although other ratios may be used.

Figure 5:
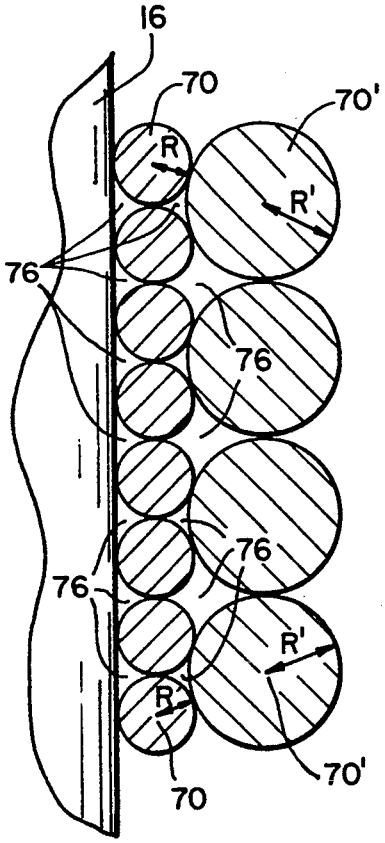
FIG. 5 is an enlarged section view of an alternate embodiment of the invention.

In a similar embodiment, FIG. 5 shows a form of the invention in which wire windings 70 and 70' are utilized having wire radii R and R' respectively. In this embodiment, radius R is less than radius R' such that the size ratio R to R' is approximately one to two. Different sizes and compositions of the wire will change their vibration reduction characteristics.

Vibration damping and reduction of compressor sound transmission are due to sliding contact between windings 60 at interface contact point 66 caused by transverse relative motion of the windings 60 and surfaces of the vibrating components (see FIG. 2). In other words, when the structural member (i.e. housing 16) vibrates, the oscillations of the conjugated windings 60 do not follow the vibration but rather slip or slide tangentially relative as to the structural member and to each other. As a result of this microfrictional effect, such relative movement transforms vibration energy to heat and thereby promotes energy dissipation.

Damping is also increased by air or gas pumping and vibrating through slots between the bounding surfaces of wires 60 at contact point 66. Wires 60 enclose finite volumes 76 of air, surrounding housing 16. This built up structure has damping in each mode of vibration far in excess of the intrinsic damping of structural member (housing) material itself. As shown in FIG. 2, arrow 72 shows the path that air molecules take while winding 60 vibrates. Arrows 74 show the direction of the main vibration pattern of windings 60. Enclosed finite volumes 76 of air help to reduce transmitted sound.

The air molecules in enclosed volumes 76 oscillate with the frequency of the exciting wave via winding 60. Changes in flow direction and expansions and contractions of the air flow through slots between windings, result in loss of momentum in the direction of the wave propagation. This phenomena accounts for most of the energy losses at high frequency. At low frequency, the added mass of the winding, to the vibratory surface of the compressor, is another source for the energy loss. Furthermore, friction produced by vibration of windings 60 cause windings 60 to heat up, thereby additionally reducing the total amount of vibration energy communicated to areas outside of the housing.

Experimental results have shown that up to 2.5 dBA reduction of overall radiated sound is possible with a single row of windings described in the present invention. The sound peaks are reduced 2 db to 5 db in the frequency range of 800 hertz to 3500 hertz with between 7 to 10 windings about the compressor.

Different degrees of vibration and noise reduction can be accomplished by changing the location and quantity of the windings or coils and by choosing a different diameter or material for the wire. Further, the amount of play between the wire windings 60 on housing 16 also may change vibration response.

By utilizing the simple form of wire loops or wire coils, the present sound and vibration absorbing damper can be used effectively for compressor vibration and noise control in almost any type of environment and over a wide range of temperatures. Further, retrofitting of compressors in the field is possible.

The sound and vibration absorbing damper does not negatively disturb heat exchange of compressor 10 with the surrounding environment. An increase in the heat transfer or heat exchange from compressor 10 to the outside environment is possible since the wire windings increase the total surface area of the compressor assembly thereby increasing the heat exchange surface. The present invention, by attachment about the outside of the compressor housing, does not interfere or alter any of the internal mechanism of the compressor.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A compressor comprising:

a housing;

a motor-compressor unit disposed within said housing for compressing fluid; and wire wrapped about said housing to form a plurality of windings, wherein adjacent windings are in contact with each other and said housing, whereby vibration energy of the housing is transformed into heat energy thereby reducing the sound emanating from the compressor.

2. The compressor of claim 1 in which said wire is wrapped about portions of said housing closest to said motor-compressor unit.

3. The compressor of claim 1 in which said wire is wrapped about portions of said housing having the highest vibration amplitude during compressor operation.

4. The compressor of claim 1 in which said wire comprises a solid core of metal.

5. The compressor of claim 1 in which said wire comprises aluminum.

6. The compressor of claim 1 in which a quantity of wire is used to reduce overall sound radiated by said compressor by at least 2.5 dBA.

7. A compressor comprising:

a housing;

a motor-compressor unit disposed within said housing for compressing fluid; and a plurality of wire windings wrapped about said housing, each said wire winding in contact with an adjacent winding, whereby each wire winding during compressor operation slides against an adjacent winding thereby dissipating vibration energy from the compressor.

8. The compressor of claim 7 in which said adjacent windings connected about said housing define enclosed volumes of air, said sliding of said windings against each other cause air to oscillate and flow into and out of said volumes whereby compressor sound levels are reduced.

9. The compressor of claim 7 in which said wire windings are connected together by a bracket.

10. The compressor of claim 9 in which said bracket comprises a U-shaped member to which said wire windings are attached.

11. The compressor of claim 10 in which said bracket is formed from an angle steel shaped length of material.

12. The compressor of claim 10 in which said bracket is formed from a single rod of material, said windings attached to said rod by crimping.

13. The compressor of claim 9 in which the surface of said housing has a refrigerant line extending therefrom, said bracket bordering said refrigerant line on said housing.

14. The compressor of claim 7 in which said wire windings are wrapped about portions of said housing having the highest acceleration during compressor operation.

15. The compressor of claim 7 in which said wire windings comprise solid core metal wire.

16. The compressor of claim 7 in which said wire windings comprise aluminum.

17. A compressor comprising:

a housing;

a motor-compressor unit disposed within said housing for compressing fluid; and a first plurality of wire windings wrapped about said housing, said windings forming a layer of wire over a portion of said housing, each said wire winding in contact with an adjacent winding;

a second plurality of wire windings wrapped about said first plurality of wire windings whereby each said wire winding during compressor operation slides against an adjacent winding thereby dissipating vibration energy from the compressor.

18. The compressor of claim 17 in which the diameter of wire in said first winding is larger than the diameter of wire in said second winding.

19. The compressor of claim 17 in which the diameter of wire in said second winding is larger than the diameter of wire in said first winding.

20. The compressor of claim 17 in which said adjacent windings connected about said housing define enclosed volumes of air, said sliding of said windings against each other cause air to flow into and out of said volumes whereby compressor sound levels are reduced.

21. The compressor of claim 17 in which said first wire windings are wrapped about portions of said housing closest to said motor-compressor unit.

22. The compressor of claim 17 in which said first wire windings are wrapped about portions of said housing having the largest vibration amplitude.

23. The compressor of claim 17 in which the wire of said first wire windings comprise a solid core of metal.

24. The compressor of claim 17 in which the wire of said second wire windings comprise a solid core of metal.

* * * * *